US010627076B2

(12) United States Patent
Chapman et al.

(10) Patent No.: US 10,627,076 B2
(45) Date of Patent: Apr. 21, 2020

(54) UNDERWATER LIGHTS WITH PORT WINDOWS INCLUDING LENS FEATURES FOR PROVIDING TAILORED OUTPUT BEAMS

(71) Applicant: DeepSea Power & Light, Inc., San Diego, CA (US)

(72) Inventors: Eric M. Chapman, Lake Tapps, WA (US); Mark S Olsson, La Jolla, CA (US); Steven C. Tietsworth, San Diego, CA (US); Aaron J. Steiner, San Diego, CA (US)

(73) Assignee: SEESCAN, INC., San Diego, CA (US)

( * ) Notice: Subject to any disclaimer, the term of this patent is extended or adjusted under 35 U.S.C. 154(b) by 0 days.

(21) Appl. No.: 15/894,868

(22) Filed: Feb. 12, 2018

(65) Prior Publication Data

US 2018/0231208 A1 Aug. 16, 2018

Related U.S. Application Data

(60) Provisional application No. 62/457,999, filed on Feb. 12, 2017.

(51) Int. Cl.

| | |
|---|---|
| ***F21V 29/00*** | (2015.01) |
| ***F21V 5/00*** | (2018.01) |
| ***F21V 5/04*** | (2006.01) |
| ***F21L 4/02*** | (2006.01) |
| ***F21V 31/00*** | (2006.01) |

(Continued)

(52) U.S. Cl.

CPC ..... *F21V 5/007* (2013.01); *F21L 4/02* (2013.01); *F21L 4/027* (2013.01); *F21V 5/006* (2013.01); *F21V 5/048* (2013.01); *F21V 31/00* (2013.01); *F21Y 2105/10* (2016.08);

(Continued)

(58) Field of Classification Search

CPC .. F21L 4/02; F21L 4/027; F21V 5/006; F21V 5/048; F21V 31/00; F21Y 2105/10; F21Y 2105/18; F21Y 2115/10

See application file for complete search history.

(56) References Cited

U.S. PATENT DOCUMENTS 9,285,109 B1 * 3/2016 Olsson ..... F21V 7/00
9,506,628 B1 11/2016 Merewether et al.

(Continued)

FOREIGN PATENT DOCUMENTS

| | | |
|---|---|---|
| DE | 10321992 A1 | 3/2005 |
| EP | 1821030 A1 | 8/2007 |
| WO | 2012/067659 A1 | 5/2012 |

OTHER PUBLICATIONS

International Searching Authority, "Written Opinion of the International Searching Authority" for PCT Application No. PCT/US18/017887, dated Aug. 16, 2018, European Patent Office, Munich.

*Primary Examiner* — Jason M Han

(74) *Attorney, Agent, or Firm* — Steven C. Tietsworth, Esq.; Michael J. Pennington, Esq.

(57) ABSTRACT

Lights with features for underwater use that provide tailored beam-width and/or other tailored light patterns are disclosed. One embodiment includes a housing having a front end with a port and a back end, a port window having a plurality of lens features positioned at the front end of the housing within or behind the port, and a circuit element, including a plurality of LED lighting elements, positioned behind the window.

19 Claims, 14 Drawing Sheets

*Example Light Embodiment with Port Window Having Multiple Internal Lens Features*

(51) Int. Cl.

| | |
|---|---|
| *F21Y 105/18* | (2016.01) |
| *F21Y 115/10* | (2016.01) |
| *F21Y 115/30* | (2016.01) |
| *F21Y 105/10* | (2016.01) |

(52) U.S. Cl.
CPC ..... *F21Y 2105/18* (2016.08); *F21Y 2115/10* (2016.08); *F21Y 2115/30* (2016.08)

(56) References Cited

U.S. PATENT DOCUMENTS

| | | | |
|---|---|---|---|
| 2010/0091493 | A1 | 4/2010 | Marson |
| 2012/0120639 | A1 | 5/2012 | Armer et al. |
| 2015/0292711 | A1 | 10/2015 | Branson et al. |

* cited by examiner

*Flat Port Window Top View*
PRIOR ART

*Flat Port Window Cutaway Side View*
PRIOR ART

Port Window with Multiple
Concave Internal Lens Features

Port Window Cutaway Cross-Sectional View
With Concave Internal Lens Features

*Example Port Window with Multiple Concave Internal Lens Features*

*Example Port Window with Multiple Concave Internal Lens Features*

Port Window with Multiple Conical Internal Lens Features

Port Window Cutaway Cross-Sectional View With Conical Internal Lens Features

Port Window with Multiple External Concave Lens Features

Window Cutaway Cross-Sectional View With External Concave Lens Features

Port Window with Circular Partially Concave Internal Lens Feature
(e.g., Cut with Ball Nose Mill)

Port Window Cutaway Cross-Sectional View
With Circular Partially Concave Internal Lens Feature Port Window with Square/Rectangular Partially Concave Internal Lens Feature (e.g., Cut with Ball Nose Mill)

Port Window with Multiple Linear Concave Internal Lens Feature (e.g., Cut with Ball Nose Mill)

Port Window with Circular Internal Conical Lens Feature

Port Window Cutaway Cross-Sectional View With Circular Interior Conical Cut Lens Feature

*Example Light Assembly Embodiment Cross-Sectional View (Portions Eliminated for Clarity)*

*Example Light Embodiment with Port Window Having Multiple Internal Lens Features*

*Detail of Port Window Embodiment with Concave Internal Lens Features*

*Port Window with Circular Partially Concave Lens Feature and LEDs Positioned About Circular Feature*

Example Embodiments of Alternate Lens Feature Shapes

UNDERWATER LIGHTS WITH PORT WINDOWS INCLUDING LENS FEATURES FOR PROVIDING TAILORED OUTPUT BEAMS

FIELD

This disclosure relates generally to lighting devices. More specifically, but not exclusively, the disclosure relates to underwater lights including a port window with concave or other light diverging or converging window features that are paired with lighting elements such as LEDs to provide a tailored output beam.

BACKGROUND

Lighting devices have long used flat windows positioned in a port ("port windows") to allow light through to an area where lighting is desired. For example, many underwater lights, particularly those for deep ocean applications, use a flat window of a high strength material such as acrylic or sapphire to withstand large external pressures at deep ocean depths such as 100 meters or more. Some underwater lights alternately use dome or similar shaped port windows.

Many modern lights use semiconductor lighting elements, typically light emitting diodes (LEDs), which provide high efficiency conversion of electrical energy to visible light or in some applications infrared ("IR") or ultraviolet ("UV") light. When used in lighting devices, the LED light output is passed through a port window, typically flat in shape, with the flat shape of the window limiting the output beam-width of the light. Many modern lights use multiple LEDs to provide more total light output and/or a slightly wider beam; however, lights using a flat port window will have a beam-width limited by the optical properties of the port material and medium the light passes through (e.g., the refractive index). These properties limit the overall beam-width of lights that use flat, smooth surface shaped port windows.

Accordingly, there is a need for improved lighting device components and assemblies to address the above described as well as other problems.

SUMMARY

This present invention relates generally to lighting devices. More specifically, but not exclusively, the disclosure relates to underwater lights including a port window with concave or other light diverging or converging window features that are paired with lighting elements such as LEDs to provide a tailored output beam.

For example, in one aspect the disclosure relates to an underwater light for ocean use at depth. The light may include a housing configured to withstand underwater pressures at a depth of approximately 100 meters or more. The housing may include a front end with a port and a back end. The housing may further include a port window, including a plurality of lens features, positioned at the front end of the housing within or behind the port. The housing may further include a circuit element, including a plurality of lighting elements, positioned behind the window, with the lighting elements positioned in correspondence with the lens features so at to generate a pre-defined tailored output beam.

The light may further include a battery disposed in the housing and electrically coupled to the circuit element for powering the lighting elements and/or a power connector disposed at the back end of the housing to provide electrical power to the circuit element and lighting elements.

The lens features may be internal and/or external lens features. The port window may be a substantially flat disc-shaped port window. One or more of the lens features may be concave, convex, or other shaped lens features on the interior side of the port window. The lighting elements may be light emitting diodes (LEDs). One or more of the lens features may be external lens features formed in an optical element attached to the window port. The window port may be a disc or other shaped port. One or more of the lens features may be concave or conical lens features cut or molded in the port window. One or more lens features may be convex lens features cut or molded in the port window.

The plurality of lens features includes may include four or more lens features. The lens features may be oriented in a circular array. The plurality of lens features may include eight or more lens features. The underwater light of claim 1, wherein the lighting elements comprise light emitting diodes (LEDs), lasers, or other light emitting devices.

The plurality of lens features comprise concave cuts or concave shapes molded in the port window and the concave cuts or molded shapes may have central axes, The LEDs or other lighting elements may positioned in correspondence with the plurality of lens features so that the central axes of the lens features are aligned with corresponding central axes of the LEDs or other lighting elements. Alternately, one or more lens features may be positioned unaligned with the central axis, such as being offset therefrom. The port window may comprise one or more of an acrylic material, a sapphire material, a polycarbonate material, a glass material, and/or other fully or partially transparent material. The port window may be colored or filtered to provide a particular spectrum or range of light output wavelengths.

Various additional aspects and details are described further below in conjunction with the appended Drawings.

BRIEF DESCRIPTION OF THE DRAWINGS

The present application may be more fully appreciated in connection with the following detailed description taken in conjunction with the accompanying drawings, wherein.

DETAILED DESCRIPTION OF EMBODIMENTS

Overview

Various additional aspects, features, and functions are described below in conjunction with the embodiments shown in FIG. 1 through FIG. 10 of the appended Drawings.

It is noted that as used herein, the term, "exemplary" means "serving as an example, instance, or illustration." Any aspect, detail, function, implementation, and/or embodiment described herein as "exemplary" is not necessarily to be construed as preferred or advantageous over other aspects and/or embodiments.

Figure 2A:
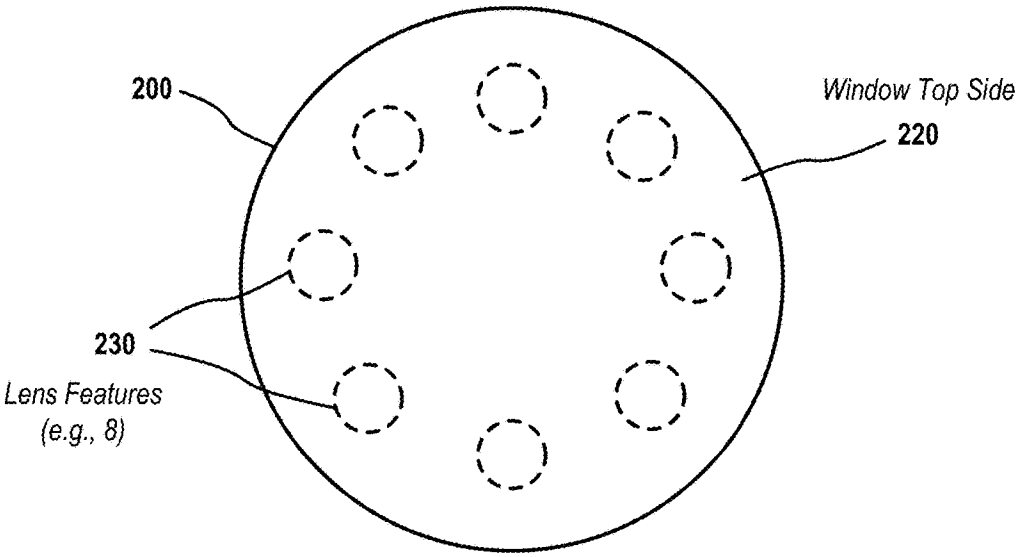
FIG. 2A and FIG. 2B illustrate details of an embodiment of a flat port window including a plurality of concave cross-sectioned internal lens features.
Figure 2B:
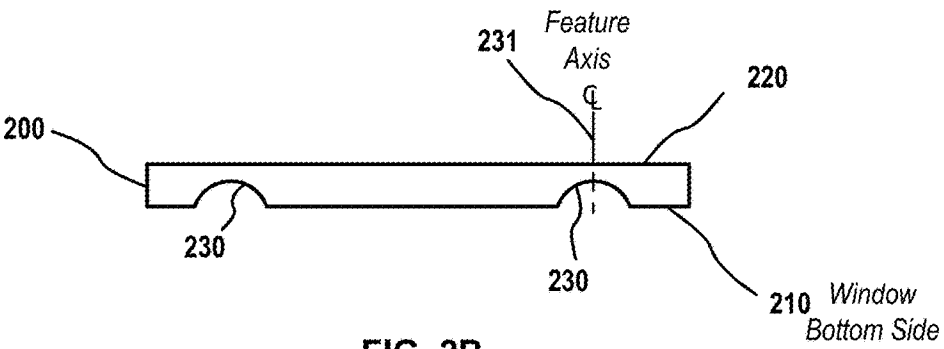

In addition, as used herein an internal lens feature is a lens feature that is cut, molded, or otherwise formed within a window port so that material is omitted or removed to form the feature (e.g., as shown as feature 230 cut or molded in the port window embodiment shown in FIG. 2B). An external lens feature is a lens feature that is attached to or raised above the surface of a port window so that additional material is effectively added to the window port (e.g., as shown as feature 430 in the port window embodiment of FIG. 4B). An exterior side or surface of a port window is that side exposed to the outside environment (e.g., seawater or other liquids or gases). An interior side or surface of a port window is the side opposite the side exposed to the outside environment. In most applications, the lens features, either internal or external, are positioned on the interior side of the window port, however, in some specialized embodiments, depending on the refractive and/or other properties of the medium and lens feature materials and shape, the lens features may be disposed on the exterior side of the window port.

Typical embodiments of the lights described herein may be used for deep ocean or other high pressure applications. For example, the associated light housing may be configured for operation at depths of 100 or more meters, 1000 or more meters, 10,000 or more meters, or other deep water applications. Some applications may include structural housings for operation to the deepest depth of the ocean at approximately 35,000 feet. Additional embodiments, however, may include housings or other structural enclosures for more shallow water operation, or, in some embodiments, for operation in the air or in other gaseous environments.

For example, in one aspect the disclosure relates to an underwater light for ocean use at depth. The light may include a housing configured to withstand underwater pressures at a depth of approximately 100 meters or more. The housing may include a front end with a port and a back end. The housing may further include a port window, including a plurality of lens features, positioned at the front end of the housing within or behind the port. The housing may further include a circuit element, including a plurality of lighting elements, positioned behind the window, with the lighting elements positioned in correspondence with the lens features so at to generate a pre-defined tailored output beam.

The light may further include a battery disposed in the housing and electrically coupled to the circuit element for powering the lighting elements and/or a power connector disposed at the back end of the housing to provide electrical power to the circuit element and lighting elements.

The lens features may be internal and/or external lens features. The port window may be a substantially flat disc-shaped port window. One or more of the lens features may be concave, convex, or other shaped lens features on the interior side of the port window. The lighting elements may be light emitting diodes (LEDs). One or more of the lens features may be external lens features formed in an optical element attached to the window port. The window port may be a disc or other shaped port. One or more of the lens features may be concave or conical lens features cut or molded in the port window. One or more lens features may be convex lens features cut or molded in the port window.

The plurality of lens features includes may include four or more lens features. The lens features may be oriented in a circular array. The plurality of lens features may include eight or more lens features. The underwater light of claim 1, wherein the lighting elements comprise light emitting diodes (LEDs), lasers, or other light emitting devices.

The plurality of lens features comprise concave cuts or concave shapes molded in the port window and the concave cuts or molded shapes may have central axes, The LEDs or other lighting elements may positioned in correspondence with the plurality of lens features so that the central axes of the lens features are aligned with corresponding central axes of the LEDs or other lighting elements. The port window may comprise one or more of an acrylic material, a sapphire material, a polycarbonate material, a glass material, and/or other fully or partially transparent material. The port window may be colored or filtered to provide a particular spectrum or range of light output wavelengths.

Various additional aspects, details, and embodiments are described further below in conjunction with the appended drawing figures.

Example Embodiments

Figure 1A:
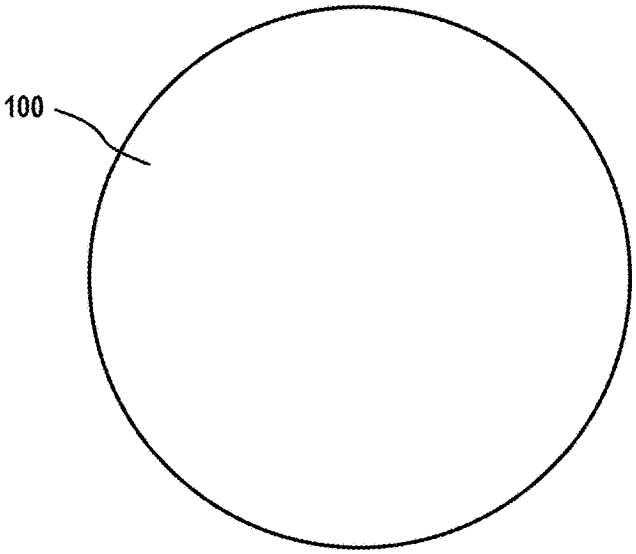
FIG. 1A and FIG. 1B illustrate details of a prior art flat port window for use in a lighting device.
Figure 1B:
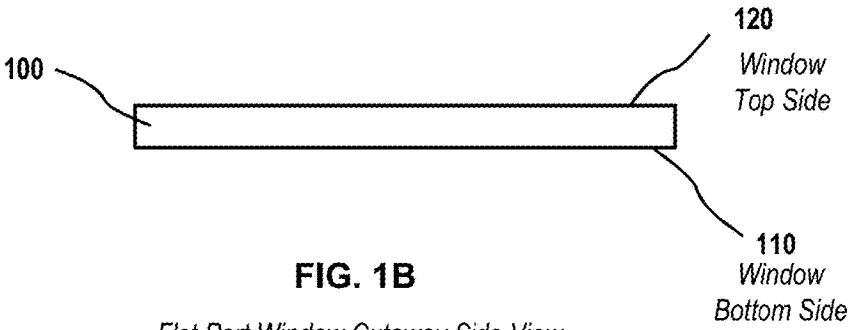

Turning to the drawings, FIG. 1A and FIG. 1B illustrate details of a typical prior art port window 100 used in underwater lights as well as other types of lighting applications. Window 100 is disc-shaped (circular when viewed looking at the top or bottom, rectangular looking side on) and has a uniform thickness and flat surface, as do typical ports for underwater lighting applications. Light passing through this type of window will be refracted as a function of the refractive index of the window material as well as the surrounding media (e.g., air, water, other liquids, etc.).

Some lights use other port shapes, such as dome shapes, and some types of optics use convex or concave shaped lenses to bend light based for a desired application. However, existing lighting device port windows, particularly those in lights using multiple LEDs (or other lighting elements), do not provide individual optical features that are associated with individual lighting elements or with arrayed lighting elements in multiple groups.

FIG. 2A and FIG. 2B illustrate details of one embodiment of a port window 200 in accordance with aspects of the present invention. Port window 200 may comprise a fully transparent, or in some embodiments partially transparent, material in a circular shape with a uniform thickness and having multiple lens features 230. In a typical embodiment with multiple lighting elements (e.g., LEDs), each lens feature is paired with one of the lighting elements; however, some embodiments may have lens features combined with multiple lighting elements or vice-versa. For example, in one embodiment, a light may include multiple groups of LEDs, with each group having its separate lens feature. Conversely, in some embodiments, each LED may have multiple associated lens features.

In various other embodiments, a port window in accordance with the presently invention may be in a shape other than circular (e.g., oval, rectangular, etc.), and may have varying thickness (rather than the uniform thickness of port window 200) with a plurality of lens features. Port window embodiments such as window 200 as well as the other embodiments described subsequently herein may comprise various materials or combinations of materials such as sapphire, acrylic, polycarbonate, polyester, nylon, amorphous nylon, glass, and/or other materials. As shown in cross-section in FIG. 2B, the lens features 230 may be cut, formed, molded, or otherwise disposed on an interior side of the port window 200. However, in some embodiments the lens features may be positioned on the exterior side of the port window (not shown in FIG. 2B).

Figure 7A:
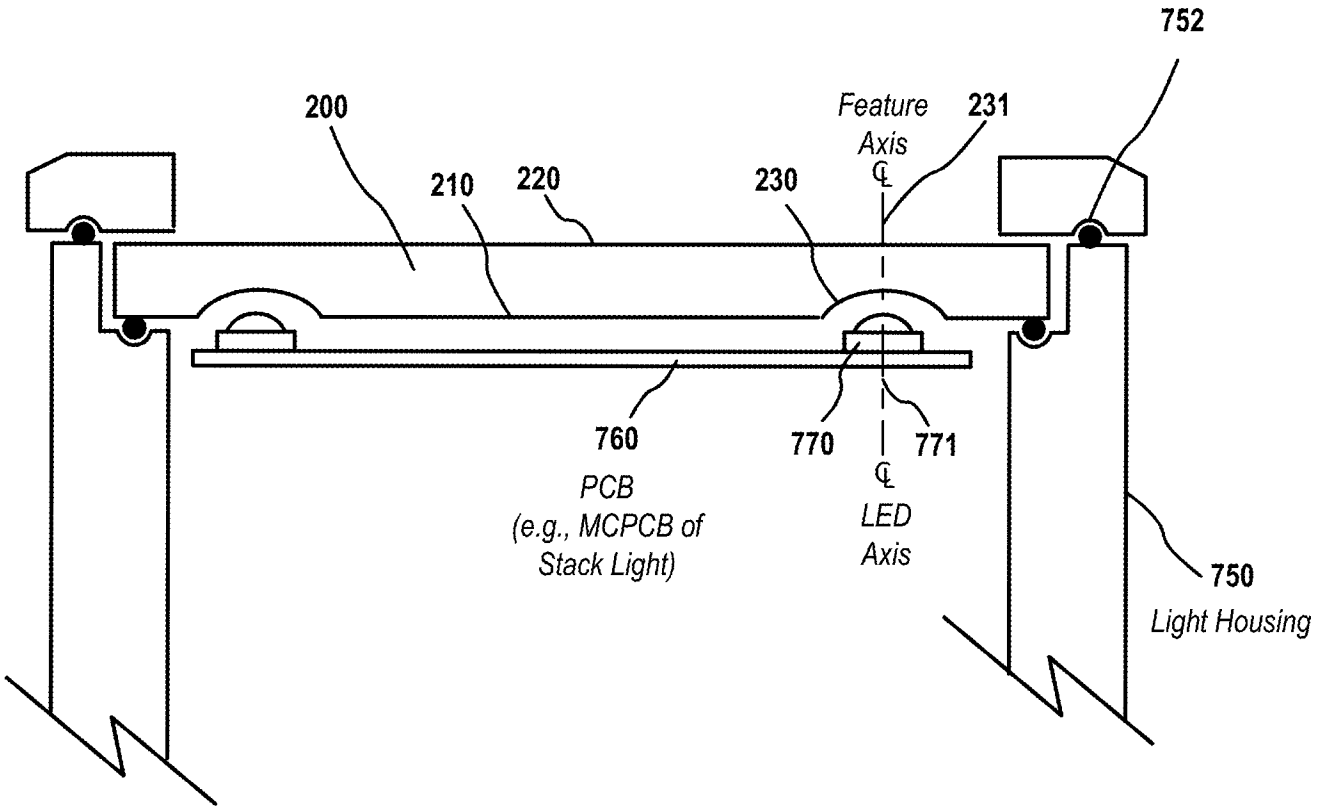
FIG. 7B illustrates details of an embodiment of a lighting device including a window, housing, and LEDs, assembled as shown in FIG. 7A.
FIG. 7C illustrates additional details of the embodiment of FIG. 7B.

In an exemplary embodiment, port window 200 includes a plurality of internal lens features 230 (in this example, eight lens features) cut, molded, or otherwise formed within the port so as to correspond with associated LEDs or other lighting elements (not specifically shown in FIG. 2A or FIG. 2B, but shown in FIG. 7A as LEDs 770). A typical lens feature creates a concave surface or other lens shape that caused divergence of light when passed through the lens feature. Conversely, some embodiments may use an alternate lens feature shape to cause light convergence rather than divergence (such as, for example, when a tailored spot or narrow beam pattern is desired). Other example lens features may be conical-shaped features, spherical-shaped lens features, aspherical-shaped lens features, compound-shaped lens features, parabolic-shaped lens features, pyramidal-shaped lens features, and the like. The particular shape of the lens features may be selected based on a desired light pattern for a particular lighting application. Some embodiments may use multiple lens features with individual features having different shapes, sizes, and/or positions in the window port to create a particular tailored light beam for a desired application.

For example, although the lens features 230 are shown in port window embodiment 200 in a circular array in the port window, they may be oriented in various other arrangements, such as rows of circular arrays, rectangular grids, non-uniformly spaced arrays, or other orientations depending on the desired position of their associated LEDs or other lighting elements in the light as well as the desired light divergence or convergence and/or pattern required by a particular lighting application.

In operation, each of lens features 230 may be positioned in the lighting device in conjunction with one or more associated LEDs (or other lighting elements) so that the lens features will be shaped with bends outward or inward to diverge or converge light from its corresponding LED or LEDs so as to broaden, narrow, or otherwise modify the corresponding beam pattern from its LED or LEDs so as to be broader or narrower than it would otherwise be if passed through a port of substantially uniform thickness. Some embodiments may use combinations of internal and external lens features, and the features may be positioned on one or both sides of the port window depending on the desired light pattern or beams and/or other parameters, such as operating environment parameters, refractive indexes, and the like. In a typical application, the lens features are positioned on the interior side of the window port.

In an exemplary embodiment, the lens features such as lens features 230 are concave-shaped cuts, milled shapes, molded shapes, or otherwise removed or omitted material from the window. The cutout may form a concave, convex, or hybrid lens within the window as an internal lens feature (such as shown in FIG. 2B). The internal lens features will diverge or converge light coming from their associated LEDs to provide a wider or narrower beam pattern, respectively, than would otherwise be provided by a flat port such as port 100 of FIG. 1A (or other port shape that lacks multiple lens features).

Figure 4A:
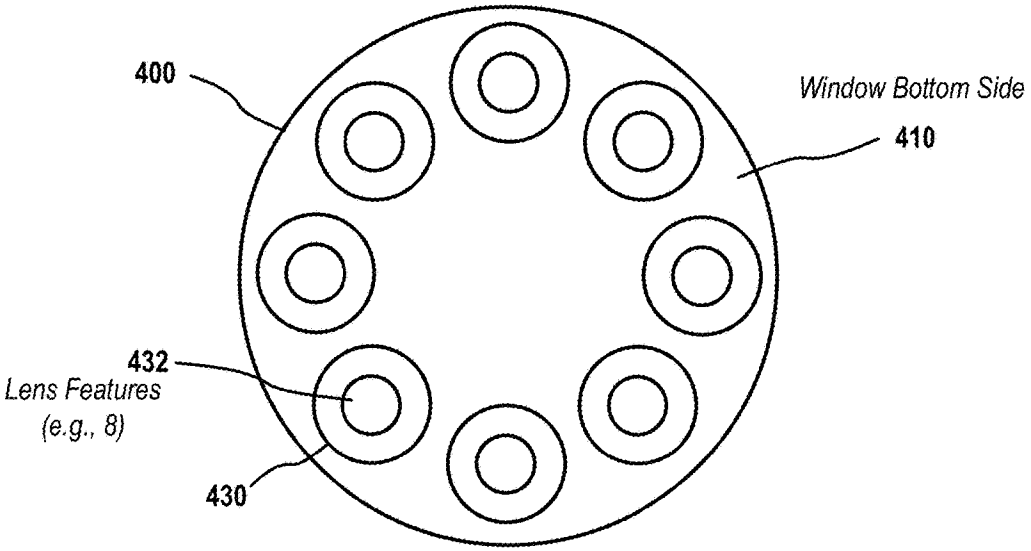
FIG. 4A and FIG. 4B illustrate details of an embodiment of a flat port window including a plurality of external concave cross-sectioned lens features positioned on the interior side of the port window.
Figure 4B:
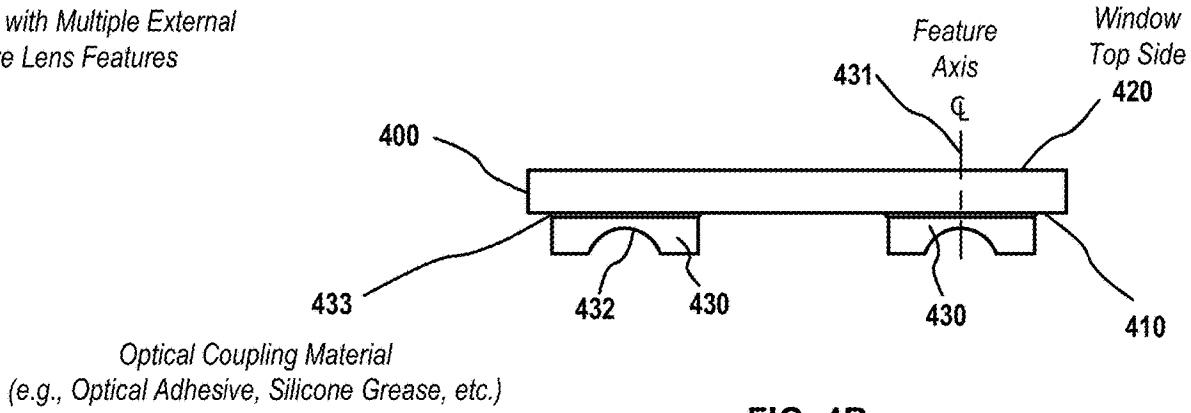

As noted previously, in some embodiments, concave lens features may be formed or attached to the surface of the port window as external lens features, rather than as cut or molded internal lens features. This may be alternately used to provide light divergence as shown in the embodiments of FIG. 4A and FIG. 4B. External lens features may be positioned on the interior or exterior sides (or both) of a port window, as may interior lens features.

In some embodiments, lens features as described herein may be formed, cut, molded, attached, or otherwise positioned on lens ports with other shapes besides flat and/or uniform port window shapes to generate a particular beam pattern or patterns from the light. Some examples of other lens feature shapes are shown in FIG. 10.

In an exemplary embodiment, each concave lens feature 230 may have a central axis 231 as shown in FIG. 2B. Axis 231 may be aligned with a corresponding central or feature axis of its associated LED (not shown in FIG. 2B, but illustrated with respect to LED 770 in FIG. 7A). In alternate embodiments, the feature axis may be unaligned, such as by being offset from the LED axis, for example, to provide a wider beam divergence in a particular direction from a specific LED and feature combination. In the illustrated embodiment shown in FIG. 2B, the top side 220 of window 200 is flat and of uniform thickness; however, it need not be so and may have other shapes and/or thicknesses and cross-sectional profiles in various embodiments.

Figure 2C:
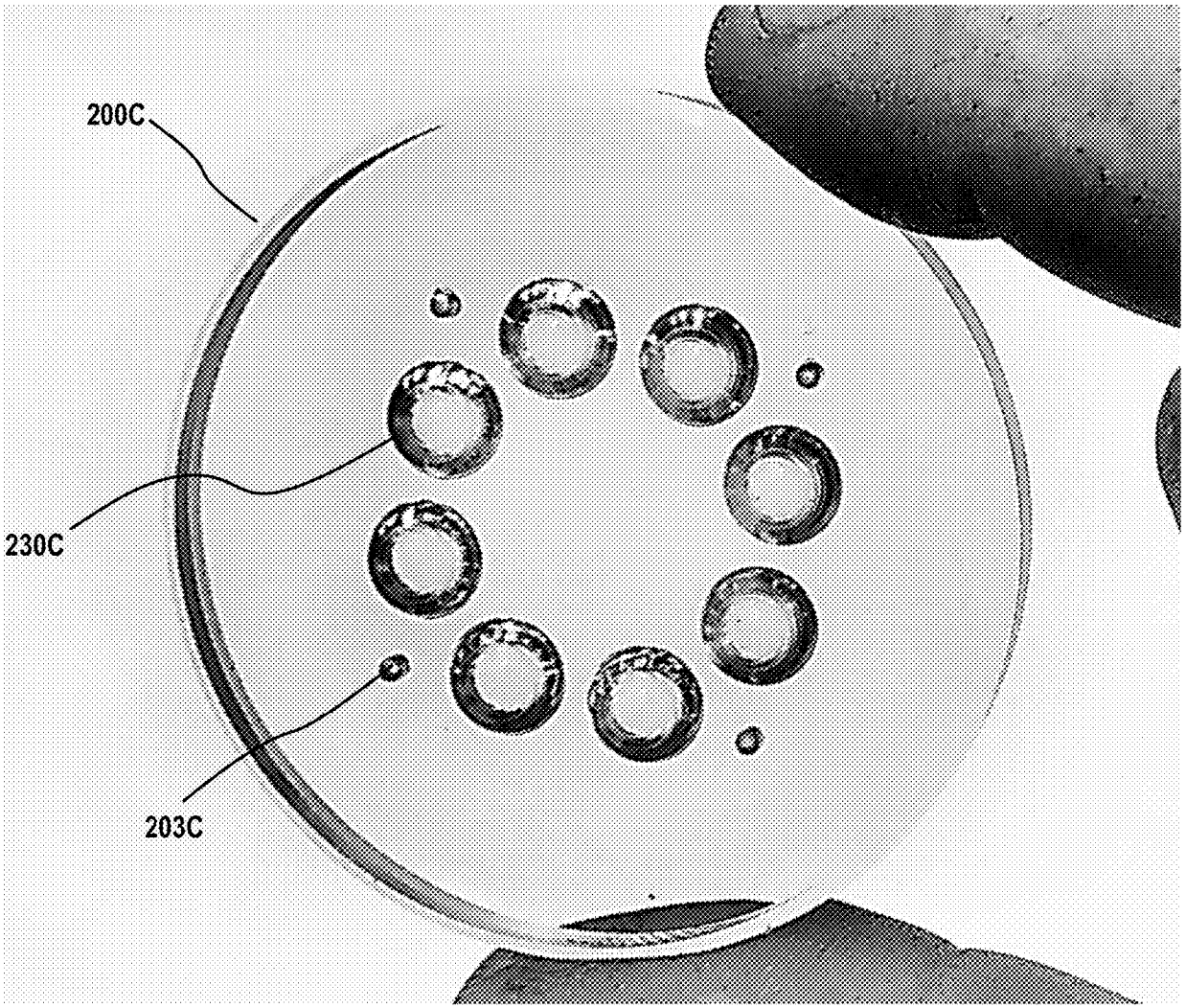
FIG. 2C and FIG. 2D illustrate an embodiment of an acrylic flat port window having eight concave cross-sectioned internal lens features cut or molded therein.
Figure 2D:
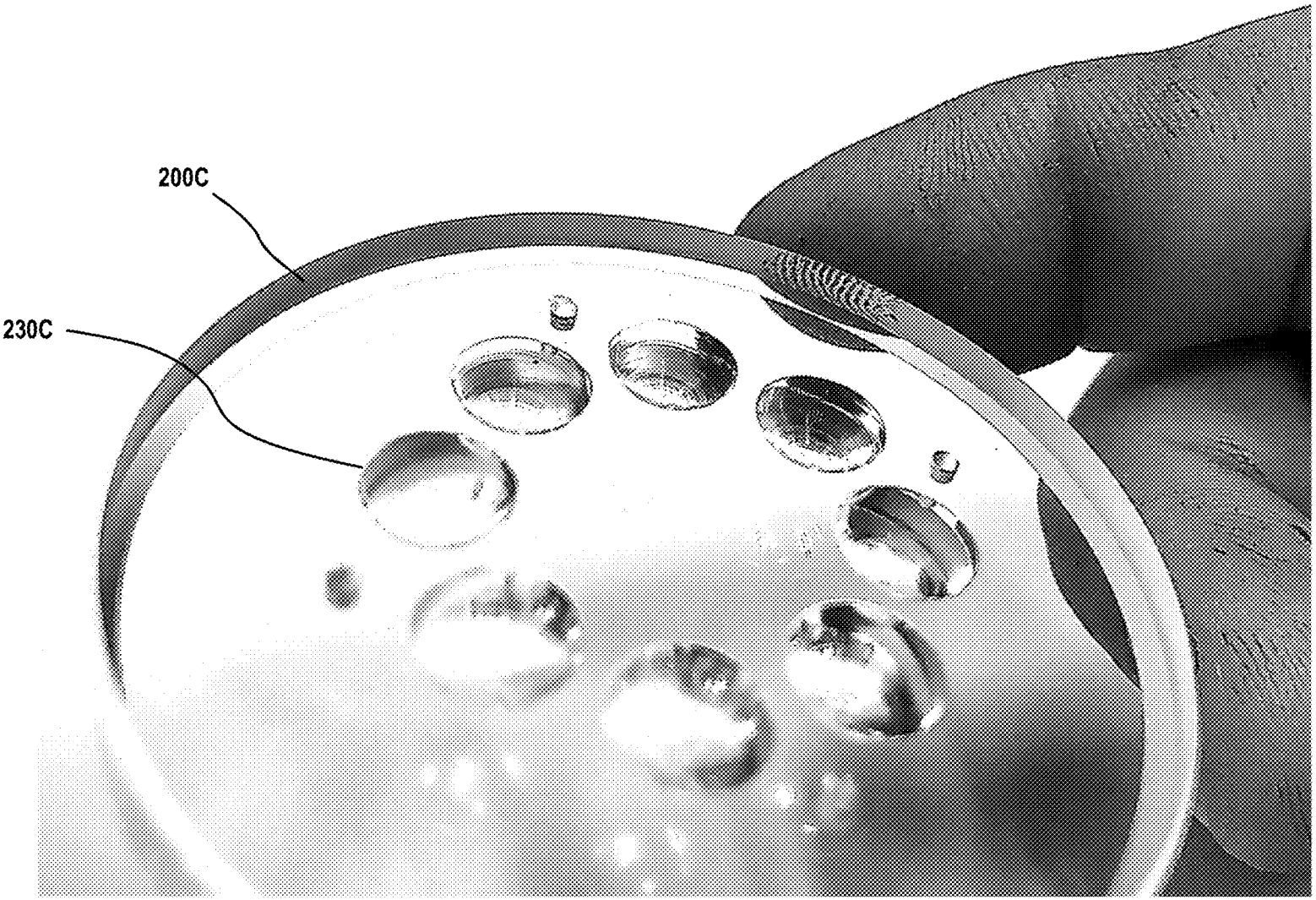

FIG. 2C illustrates details of one implementation of a port window 200C with internal lens features 230C machined into flat circular window 200C as shown. Mounting holes 203C are also shown in FIG. 2C. FIG. 2D is an image of window 200C from an angled view showing additional details of formation of the concave lens features 230C.

Figure 3A:
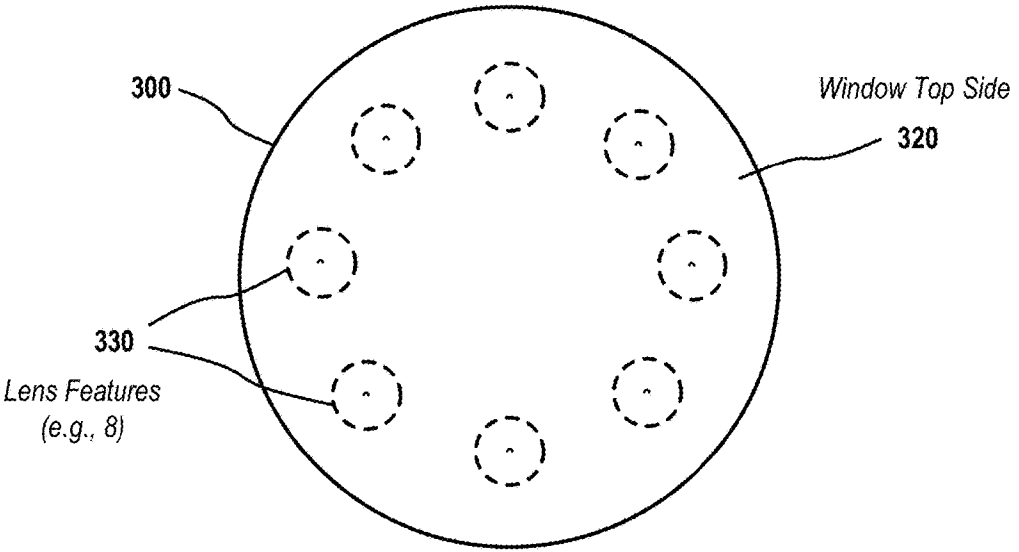
FIG. 3A and FIG. 3B illustrate details of an embodiment of a flat port window including a plurality of internal conical cross-sectioned internal lens features.
Figure 3B:
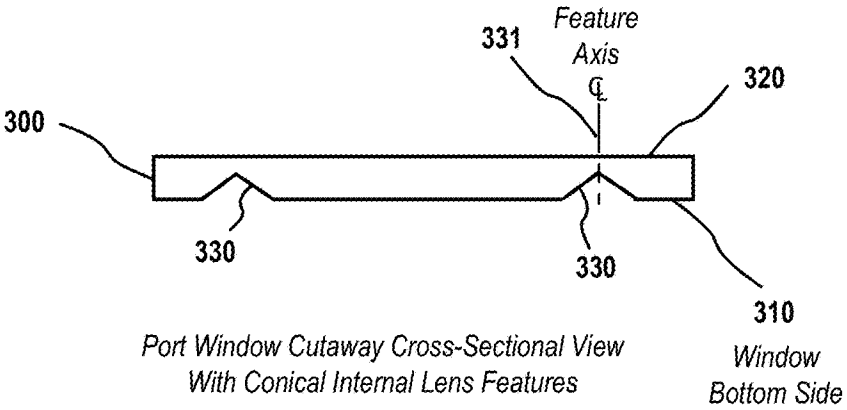

FIG. 3A and FIG. 3B illustrate details of another embodiment of a port window in the form of window 300, which includes conical cross-sectional shaped internal lens features 330. Port window 300 has the same number of lens features 330 as port window 200, however, as with port window 200 it may likewise have different numbers and/or arrangement of lens features and the port window may likewise be of different shapes, sizes, thicknesses, etc.

In an exemplary embodiment, lens feature 330 may have a central axis 331 as shown in FIG. 3B. In an exemplary embodiment, axis 331 may be aligned with a corresponding central or feature axis of its associated LED (not shown in FIG. 3B, but illustrated with respect to LED 770 in FIG. 7A). In alternate embodiments, the feature axis may be offset from the LED axis, for example, to provide a wider beam divergence in a particular direction from a specific LED and feature combination. In this embodiment the top side 320 of window 300 is flat, however, it need not be so and may have other shapes in various embodiments.

FIG. 4A and FIG. 4B illustrate details of another embodiment of a port window in the form of port window 300, which includes external lens features 432 in external optical element 430. External optical element 430 may be a piece of the same type of material as the port window or, in some embodiments, may be of a different material, such as to control refraction or for physical/structural reasons, light coloration or filtering, or to adjust other parameters of the tailored light. For example, in some embodiment the different material may be selected so as to have pre-defined optical features such as a different color, refractive index, or other properties to control the transmission and/or refraction of light. Specific lens features 432, such as concave-shaped cut or molded features or other features such as conical features, etc., may be formed or cut into the external optical element 430 so as to provide light divergence as with corresponding internal lens features described previously herein. In some embodiments, the external optical element 430 may be molded or cut directly from a port window blank rather than being separate made and attached to the window. Combinations of internal and external lens features providing convergent and divergent beams may be used to provide specifically tailored light for a particular application. As with internal lens features, external lens features may comprise concave, convex, spherical, round, triangular, or other lens shapes as described herein.

In some embodiments, an optical coupling material 433, such as an optical adhesive, silicone or other optical grease and the like may be placed between the external optical element 430 and the window 400 so as to maximize light transmission between the two elements. As with the previously described embodiments, port window 400 it may likewise have different numbers and/or arrangement of lens features and the port window may likewise be of different shapes, sizes, thicknesses, etc.

In an exemplary embodiment, each concave lens feature 430 may have a central axis 431 as shown in FIG. 4B. Axis 431 may be aligned with a corresponding central or feature axis of its associated LED (not shown in FIG. 4B, but illustrated with respect to LED 770 in FIG. 7A). In alternate embodiments, the feature axis may be offset from the LED axis, for example, to provide a wider beam divergence in a particular direction from a specific LED and feature combination. In this embodiment the top side 420 of window 400 is flat; however, it need not be so and may have other shapes in various embodiments.

Figure 5A:
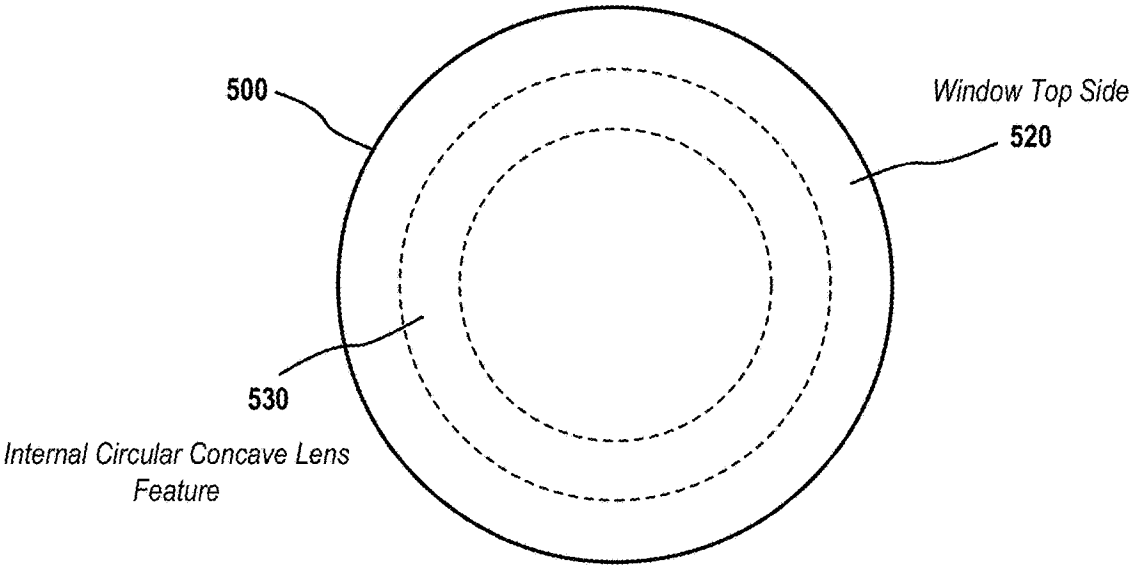
FIG. 5A and FIG. 5B illustrate details of an embodiment of a flat port window including a single circular internal partially concave cross-sectioned lens feature.
Figure 5B:
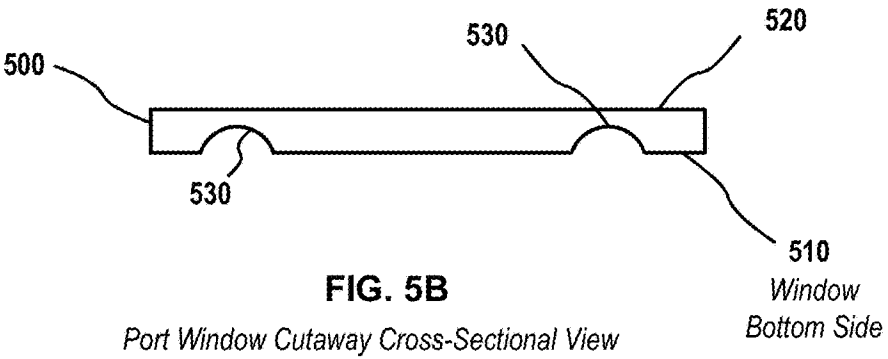

FIG. 5A and FIG. 5B illustrate details of another embodiment of a port window in the form of window 500. Window 500 differs from the previously illustrated port window embodiments as it has a single circular lens feature 530 in the form of a circular-shaped partially concave internal groove in window 500 cut or molded in the interior side 510 of port window 500 (although alternate embodiments may include additional circular lens features and/or additional lens features as described previously herein in addition to feature 530). In this embodiment, a plurality of lighting elements such as LEDs (not shown in FIG. 5A or FIG. 5B) may be positioned in a circular array behind the circular lens feature so that the circular lens feature causes divergence of a portion of the light emitted from the LEDs. In this embodiment the top side 520 of window 500 is flat, however, it need not be so and may have other shapes in various embodiments.

In alternate embodiments, a port window such as window 500 may have a lens feature or features similar to the circular lens feature 530 that are cut or molded in the window in a shape other than circular, such as in the form of one or more lines, ovals, squares or rectangles, triangles, irregular arrays, etc., with LEDs positioned behind the lens feature so that the lens feature causes the light from the LEDs to diverge or converge to a desired tailored beam pattern or patterns.

Figure 5C:
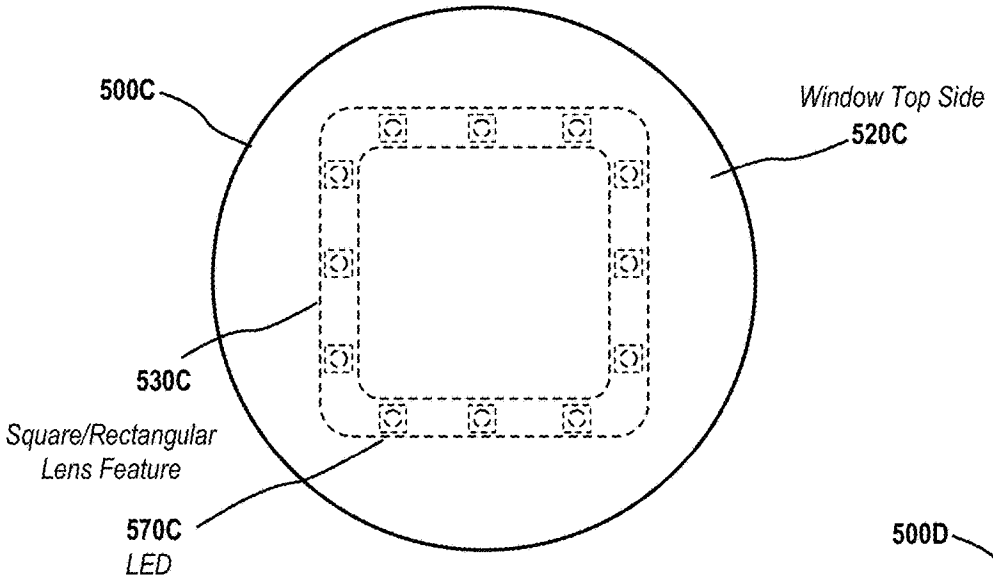
FIG. 5C illustrates details of an embodiment of a flat port window including a single square lens feature with a partially concave cross-section.

For example, FIG. 5C illustrates an alternate window embodiment 500C including a square-shaped lens feature 530C cut, molded, or otherwise formed on a bottom side of the window (opposite the top side 520C as marked in FIG. 5C). LEDs 570C may be positioned behind the window in correspondence with the lens feature 570C as shown in FIG. 5C.

Figure 5D:
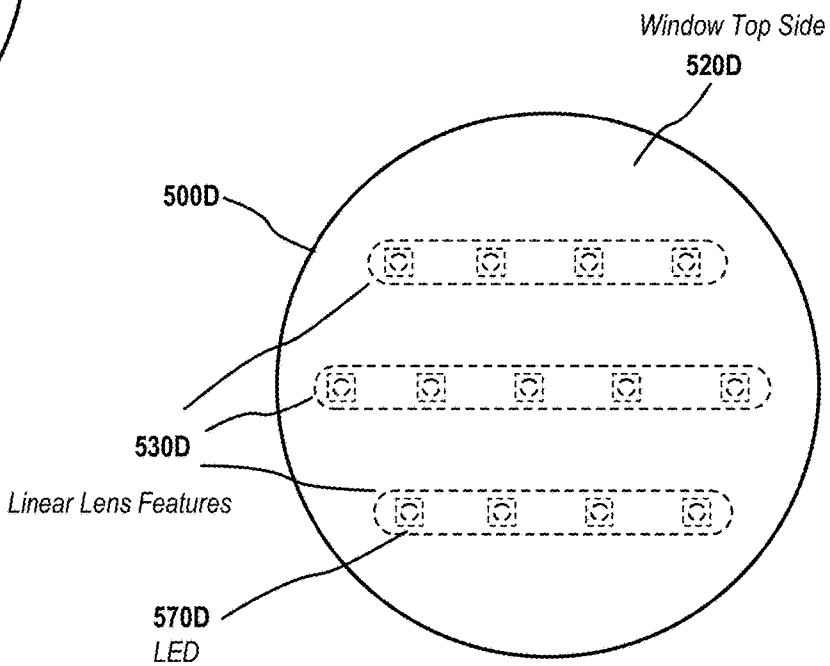
FIG. 5D illustrates details of an embodiment of a flat port window including a plurality of linear lens features having a partially concave cross-section.

FIG. 5D illustrates another alternate window embodiment 500D including multiple linear lens features 530D (in this example three, but other numbers may be used and may be combined with circular or other lens features) cut, molded, or otherwise formed on a bottom side of the window (opposite the top side 520D as marked in FIG. 5D). LEDs 570D may be positioned behind the window in correspondence with the lens feature 570D as shown in FIG. 5D.

Figure 8:
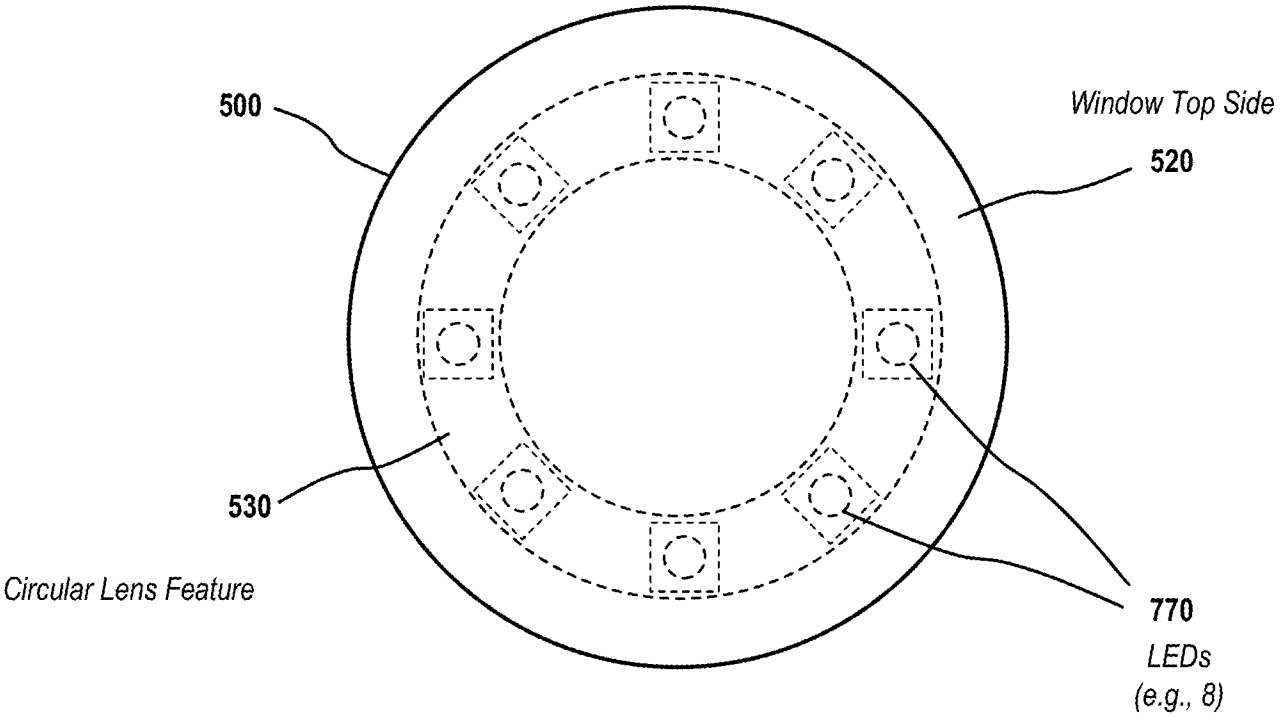
FIG. 8 illustrates details of the flat port window of FIG. 5A and FIG. 5B with the circular partially concave lens feature positioned in correspondence with a plurality of LEDs.

FIG. 8 illustrates additional details of port window embodiment 500 as placed in front of an associated circuit board having a plurality of LEDs 770. In this embodiment, light from the LEDs 770 is divergent outward (towards the circumference) and inward further than it would otherwise be divergent through a flat port window or a window lacking the circular lens feature 530. This results in a wider beam than through a conventional flat port window.

Figure 6A:
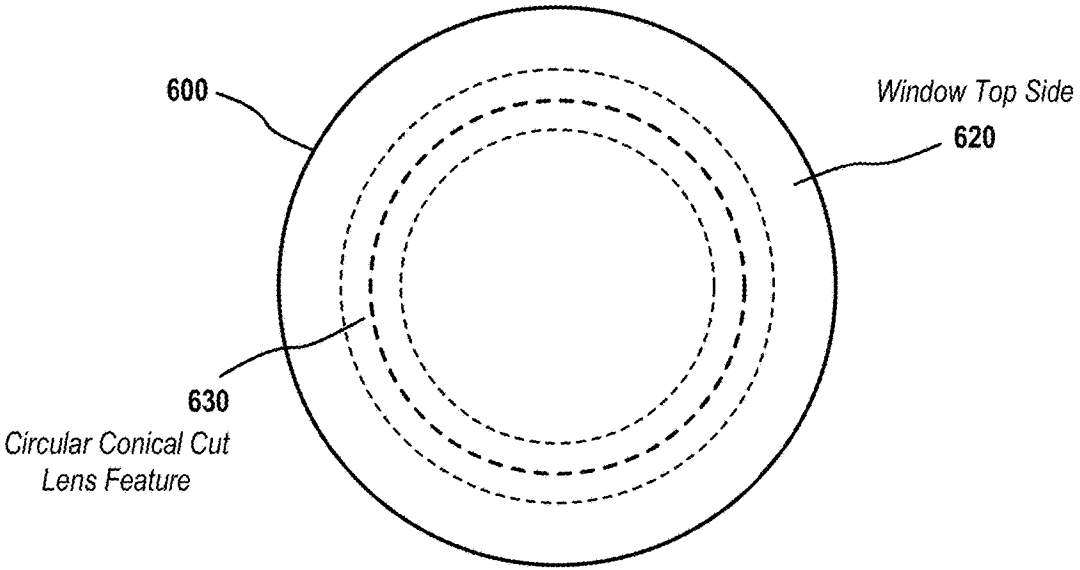
FIG. 6A and FIG. 6B illustrate details of an embodiment of a flat port window including a single circular conical cross-sectioned lens feature FIG. 7A illustrate details of a lighting device embodiment including a flat port window with a plurality of concave internal lens features, with the features positioned in correspondence with associated light emitting diodes (LEDs).
Figure 6B:
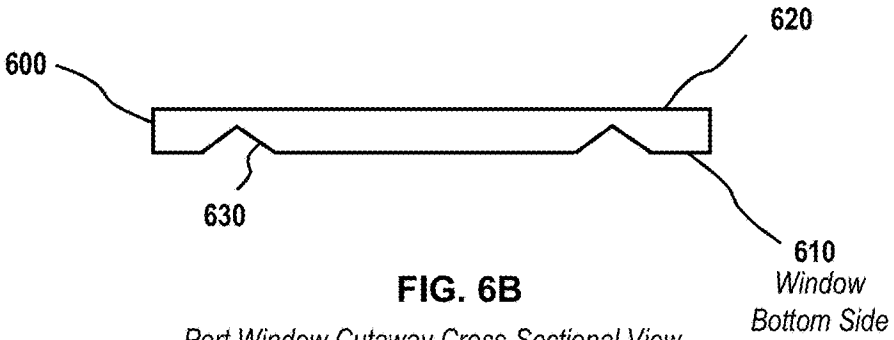

The cross-sectional shape of the lens feature 530 may, in alternate embodiments, have shapes other than a circular or oval shape as shown in FIG. 5B, such as a partially rectangular or square shape, or other shapes that bend light rays in a particular targeted direction. FIG. 6A and FIG. 6B illustrate one such alternate cross-sectional shape in the form of a triangular cross-section.

In an exemplary embodiment, the center circle of feature 530 may be aligned with axes of the associated LEDs. In alternate embodiments, the center circle of feature 530 may be offset from the LED axes to, for example, provide a wider beam divergence in a particular direction from a specific LED.

FIG. 6A and FIG. 6B illustrate details of another embodiment of a port window in the form of round port window 600 with internal lens features. Window 600 is similar to window 500, however, the circular feature 630 is a cut or molded internal lens feature on the interior side 610 of port window 600, with the feature having a triangular cross-sectional shape rather than a circular or oval cross-sectional shape as in window 500. In this embodiment the top side 620 of window 600 is flat; however, it need not be so and may have other shapes in various embodiments.

In an exemplary embodiment, the center of triangular feature 630 may be aligned with axes of the associated LEDs. In alternate embodiments, the center of feature 630 may be offset from the LED axes to, for example, provide a wider beam divergence in a particular direction from a specific LED.

In various embodiments, the port window embodiments described previously herein may be used in an underwater light to provide a wider and/or directionally tailored light shape. For example, the port windows described herein may be used in various embodiments of lights in combination with other lighting elements and configurations such as those described in co-assigned patent applications and patents including: U.S. patent application Ser. No. 12/844,759, entitled SUBMERSIBLE LED LIGHT FIXTURE WITH MULTILAYER STACK FOR PRESSURE TRANSFER, filed Jul. 27, 2010, U.S. Pat. No. 8,033,677, entitled DEEP SUBMERSIBLE LIGHT WITH PRESSURE COMPENSATION, issued Oct. 11, 2011, U.S. Pat. No. 8,167,468, entitled LED LIGHTING FIXTURES WITH ENHANCED HEAT DISSIPATION, issued May 1, 2012, U.S. Pat. No. 8,616,725, entitled LED SPHERICAL LIGHT FIXTURES WITH ENHANCED HEAT DISSIPATION, issued Dec. 31, 2013, U.S. Pat. No. 9,091,416, entitled PATHWAY ILLUMINATION DEVICES, METHODS, AND SYSTEMS, issued Jul. 28, 2015, U.S. Pat. No. 9,151,484, entitled LED LIGHTING DEVICES AND SYSTEMS FOR MARINE AND SHORELINE ENVIRONMENTS, issued Oct. 6, 2015, U.S. Pat. No. 9,429,301, entitled SEMICONDUCTOR LIGHTING DEVICES AND METHODS, issued Aug. 30, 2016, U.S. Pat. No. 9,506,628, entitled SEMICONDUCTOR LIGHTING DEVICES AND METHODS, issued Nov. 29, 2016, and U.S. Pat. No. 9,574,760, entitled LIGHT FIXTURE WITH INTERNALLY-LOADED MULTILAYER STACK FOR PRESSURE TRANSFER, scheduled to issue on Feb. 21, 2017. Each of the above applications and patents are incorporated by reference herein in their entirety and may be denoted as the "incorporated applications" for brevity.

Figure 7B:
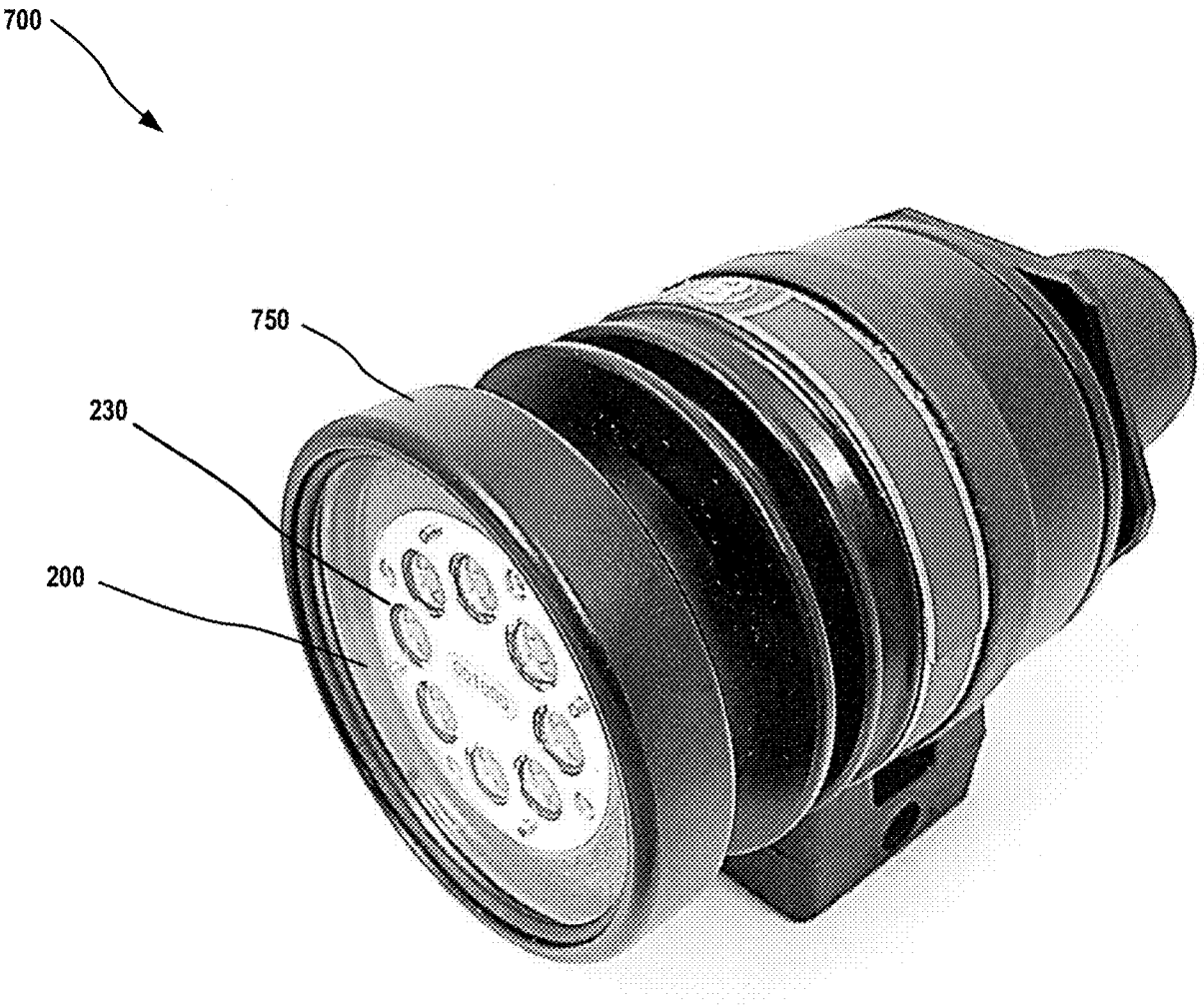

FIG. 7A illustrates details of use of a port window such as described previously herein in an underwater light embodiment, such as the light shown in FIG. 7B. Any of the port windows described previously herein, with any of the various port window features as described herein, as well as their equivalents and variants described herein, may be used in various similar light embodiments.

As shown in FIG. 7A, a port window, such as, for example, port window 200 having multiple internal lens features, may be positioned in a light housing or other structure 750 in front of a printed circuit board 760 or other substrate or mounting element for a plurality of lighting elements, such as LEDs 770 having a central axis 771 as shown. In an exemplary embodiment the printed circuit board and LEDs are of the type described in the incorporated applications as a "stack light" configuration. Exemplary stack light embodiments are described in co-assigned and incorporated U.S. patent application Ser. No. 12/844,759, and additional details are described in incorporated U.S. Pat. No. 9,754,760.

In the embodiment of FIG. 7A, the LED axis 771 is aligned with the centerline of concave feature 230 axis 231 to provide substantially uniform divergence of light out of window 200. Other orientations, however, may also be used to shape the output light beam to a different predefined pattern or beam shape. O-rings 752 may be used to seal the front or light output end of the light of FIG. 7A. A battery 780 may be provided for powering the lighting elements. Various additional details of various light housings and related electronics, mechanical features, port windows that may be combined with the disclosures herein in additional embodiments are further illustrated in the incorporated applications.

FIG. 7B illustrates an exemplary embodiment of a light 700 including a housing 750 with a port window, such as port window 200, having multiple lens features 230 to broaden the associated output light beam. A stack light internal circuit board and optics configuration, such as described in U.S. patent application Ser. No. 12/844,759, entitled SUBMERSIBLE LED LIGHT FIXTURE WITH MULTILAYER STACK FOR PRESSURE TRANSFER, filed Jul. 27, 2010, may be used within light housing 750 to generate power and signaling to control LEDs and also transfer pressure through the window 200, one or more circuit boards, and to the housing.

Figure 7C:
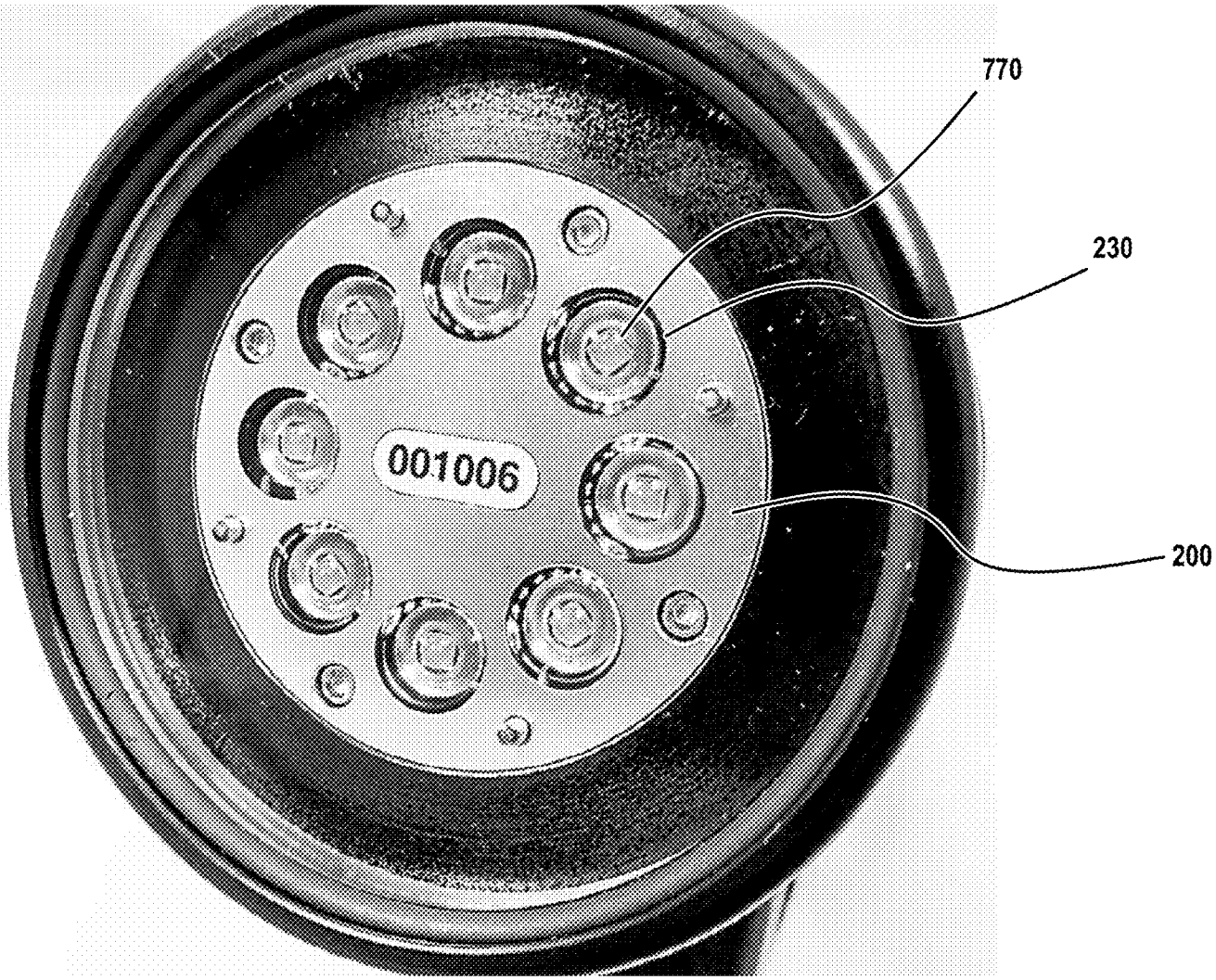

FIG. 7C illustrates additional details of the port window of embodiment 700. As shown in FIG. 7C, the port window 200 may include a plurality (e.g., 8 in this example) of internal lens features 230 associated with corresponding LEDs 770.

Figure 9:
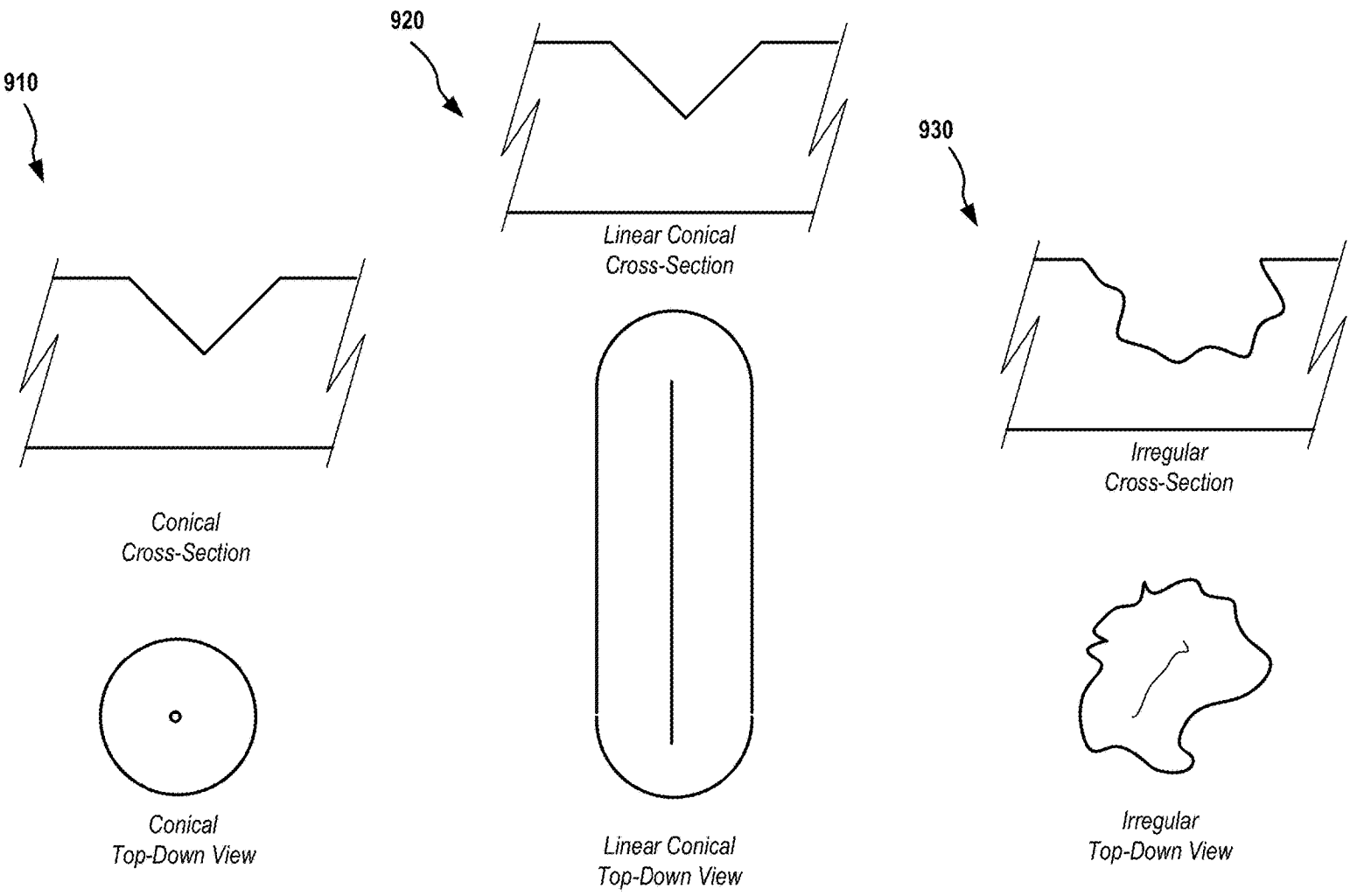
FIG. 9 illustrates details of various embodiments of alternate lens feature shapes.

FIG. 9 illustrates details of other example port window lens features that may be used in various embodiments. Window port detail 910 shows a conical cross-sectioned internal port window feature from a side and top down view. Detail 920 shows a linear-conical internal port window feature, likewise from a top down and cross-sectional view. Detail 930 shows yet another embodiment of a window feature with an irregular shape. The irregular shape may be in the top down orientation, cross-sectional orientation, or both, depending on the desired light pattern. Window port detail 940 shows a convex cross-sectioned internal port window feature from a side and top down view. The examples of FIG. 9 are shown merely to illustrate the variety of shapes, positions, and sizes of internal or external features that may be used in various embodiments and is not intended to be limiting in any way.

As noted previously herein, internal and external lens features may include shapes other than concave, conical, or pyramidal/triangular. For example, some embodiments may use spherical, aspherical, compound, and/or parabolic shaped lens features. For example, in one application a tailored beam may be in a "bat wing" shaped pattern, in which case a beam may be formed using a window feature shaped with a compound surface with conical and spherical shaped feature elements. In addition, while most of the examples herein illustrate and describe symmetric lens features, in some embodiments an asymmetric feature shape may be desirable. For example, use of oblong, oval, or other irregular shapes may be used in lens features to provide a particular tailored beam shape.

Further, while typical applications provide divergent, "outward bent" beam shapes, in some embodiments such as noted previously herein, a partially or fully narrowed beam pattern may be desired. For example, narrowed beams may be used for a spot light beam pattern, or an asymmetrical beam pattern with broadening in one direction and narrowing in another may be desired. These beams may be formed with correspondingly shaped lens features, either alone or in combination in the form of multiple differently-shaped lens features, which may be internal, external, or both.

The scope of the present invention is not intended to be limited just to the aspects shown herein, but is to be accorded the full scope consistent with the disclosures and drawings and their equivalents, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c.

It is noted that as used herein the terms "component," "unit," "element," or other singular terms may refer to two or more of those members. For example, a "component" may comprise multiple components. Moreover, the terms "component," "unit," "element," or other descriptive terms may be used to describe a general feature or function of a group of components, units, elements, or other items. For example, an "RFID unit" may refer to the primary function of the unit, but the physical unit may include non-RFID components, sub-units, and such.

The previous description of the disclosed aspects is provided to enable any person skilled in the art to make or use embodiments of the present invention. Various modifications to these aspects will be readily apparent to those skilled in the art, and the generic principles defined herein may be applied to other aspects without departing from the spirit or scope of the disclosure. For example, features described previously with respect to specific embodiments may be combined with features described previously with respect to other embodiment in yet further embodiments in accordance with the invention. Thus, the presently claimed invention is not intended to be limited only to the aspects shown herein but is to be accorded the widest scope consistent with the appended Claims and their equivalents.

We claim:

1. An underwater light, comprising:

a housing configured to withstand underwater pressures at a depth of approximately 100 meters or more, the housing having a front end with a port and a back end;

a port window, including concave lens features, positioned at the front end of the housing within or behind the port; and a circuit element, including a plurality of lighting elements, positioned behind the window, with the lighting elements positioned in correspondence with the lens features so as to generate a pre-defined tailored output beam.

2. The light of claim 1, further comprising a battery disposed in the housing and electrically coupled to the circuit element for powering the lighting elements.

3. The light of claim 1, further comprising a power connector disposed at the back end of the housing to provide electrical power to the circuit element and lighting elements.

4. The light of claim 1, wherein the lens features comprise internal lens features.

5. The light of claim 3, wherein the port window is a substantially flat disc-shaped port window, wherein the concave lens features are on the interior side of the port window, and the lighting elements are light emitting diodes (LEDs).

6. The light of claim 1, wherein one or more of the lens features comprise external lens features formed in an optical element attached to a window port disc.

7. The light of claim 1, wherein the concave lens features are cut or molded in the port window.

8. The underwater light of claim 1, wherein the lighting elements comprise light emitting diodes (LEDs).

9. The underwater light of claim 1, wherein the lighting elements comprise lasers.

10. The underwater light of claim 1, wherein the concave lens features comprise concave cuts or concave shapes molded in the port window and the concave cuts or molded shapes have central axes; wherein the LEDs are positioned in correspondence with the plurality of lens features so that the central axes of the lens features are aligned with corresponding central axes of the LEDs.

11. The underwater light of claim 1, wherein the concave lens features comprise concave cuts or concave shapes molded in the port window and the concave cuts or molded shapes have central axes; wherein the LEDs are positioned in correspondence with the plurality of lens features so that the central axes of the lens features are positioned off-axis aligned with corresponding central axes of the LEDs.

12. The underwater light of claim 1, wherein the port window comprises an acrylic material.

13. The underwater light of claim 1, wherein the port window comprises a sapphire material.

14. The underwater light of claim 1, wherein the port window comprises a polycarbonate material.

15. An underwater light, comprising:

a housing configured to withstand underwater pressures at a depth of approximately 100 meters or more, the housing having a front end with a port and a back end;

a port window, including one of a circular-shaped lens feature or a linear-shaped lens feature having a conical or concave cross-sectional shape, positioned at the front end of the housing within or behind the port; and a circuit element, including a plurality of lighting elements, positioned behind the window, with the lighting elements positioned in correspondence with the lens features so as to generate a pre-defined tailored output beam.

16. An underwater light, comprising:

a housing configured to withstand underwater pressures at a depth of approximately 100 meters or more, the housing having a front end with a port and a back end;

a port window, including convex lens features cut or molded in the port window, positioned at the front end of the housing within or behind the port; and a circuit element, including a plurality of lighting elements, positioned behind the window, with the lighting elements positioned in correspondence with the lens features so as to generate a pre-defined tailored output beam.

17. An underwater light, comprising:

a housing configured to withstand underwater pressures at a depth of approximately 100 meters or more, the housing having a front end with a port and a back end;

a port window, including conical shape lens features cut or molded in the port window, positioned at the front end of the housing within or behind the port; and a circuit element, including a plurality of lighting elements, positioned behind the window, with the lighting elements positioned in correspondence with the lens features so as to generate a pre-defined tailored output beam.

18. An underwater light, comprising:

a housing configured to withstand underwater pressures at a depth of approximately 100 meters or more, the housing having a front end with a port and a back end;

a port window, including four or more lens features in a circular array, positioned at the front end of the housing within or behind the port; and a circuit element, including a plurality of lighting elements, positioned behind the window, with the lighting elements positioned in correspondence with the lens features so as to generate a pre-defined tailored output beam.

19. An underwater light, comprising:

a housing configured to withstand underwater pressures at a depth of approximately 100 meters or more, the housing having a front end with a port and a back end;

a port window, including eight or more lens features in a circular array, positioned at the front end of the housing within or behind the port; and a circuit element, including a plurality of lighting elements, positioned behind the window, with the lighting elements positioned in correspondence with the lens features so as to generate a pre-defined tailored output beam.

* * * * *